United States Patent [19]

Widell

[11] 4,146,390

[45] * Mar. 27, 1979

[54] FURNACE AND METHOD FOR THE MELT REDUCTION OF IRON OXIDE

[75] Inventor: Björn Widell, Vesterås, Sweden

[73] Assignee: ASEA Aktiebolag, Vesterås, Sweden

[ * ] Notice: The portion of the term of this patent subsequent to Feb. 24, 1993, has been disclaimed.

[21] Appl. No.: 782,085

[22] Filed: Mar. 28, 1977

Related U.S. Application Data

[63] Continuation-in-part of Ser. No. 588,179, Jun. 19, 1975, abandoned.

[51] Int. Cl.[2] ..... C21C 5/52; H05B 7/20

[52] U.S. Cl. ..... 75/11; 13/9 R

[58] Field of Search ..... 75/10–12

[56] References Cited

U.S. PATENT DOCUMENTS

| | | | |
|---|---|---|---|
| 2,303,973 | 12/1942 | Armstrong | 75/10 |
| 2,909,422 | 10/1959 | Schwabe | 75/12 |
| 3,101,385 | 8/1963 | Robinson | 75/12 |
| 3,940,551 | 2/1976 | Widell | 75/11 |

*Primary Examiner*—P. D. Rosenberg

*Attorney, Agent, or Firm*—Kenyon & Kenyon, Reilly, Carr & Chapin

[57] ABSTRACT

A DC arc furnace has a cathodic tubular graphite electrode forming an arc with an anodic carbonaceous iron melt in the furnace. A mixture of iron oxide and carbon particles is fed to the melt via the electrode's interior with the mixture's carbon content being in excess of that stoichiometrically required to reduce the iron oxide content of the mixture, the upper end of the electrode's feeding passage being blocked so that furnace gases cannot flow upwardly and impede the mixture's downward feeding flow.

1 Claim, 5 Drawing Figures

FURNACE AND METHOD FOR THE MELT REDUCTION OF IRON OXIDE

BACKGROUND OF THE INVENTION

This application is a continuation-in-part of Ser. No. 588,179 filed June 19, 1975, now abandoned.

In the melt reduction of iron oxides, which may include other components as in the case of iron ore, the iron oxide material in powder or granular form is continuously fed to a molten carbonaceous iron bath where the carbon reacts with the oxygen to form the iron bath which is tapped continuously or as required from the hearth containing the bath.

When practicing this technique, it is often the second stage of a two-stage reduction of the iron oxides, the first stage comprising a prereduction effected by heating the iron oxide material while in a reducing gas, this first stage only partially reducing the iron oxide content of the material involed. In the case of iron ore, the gangue results in a slag floating on the molten bath, and the latter may also support a layer of carbonaceous material such as coke particles. Such layers floating on the bath prevent direct contact with the latter by the iron oxide material, preventing a rapid reduction of the iron oxide.

It is desirable to feed both the iron oxide material and the carbonaceous material, and possibly flux, to the bath in the form of streams of powder having a relatively fine particle size. Particularly when arc heating is used, this practice involves the disadvantage that the powder material is blown about above the carbonaceous bath, making difficult its feeding to any desired location.

Also, for the melt reduction technique the hearth containing the carbonaceous bath is ordinarily enclosed so that the gas resulting from the reaction of the iron oxide with the carbon can be carried away via an exhaust arrangement. Therefore, if the powdered material is floating around within the enclosed hearth, an undesirably large amount may be drawn off by the exhaust instead of contacting the bath.

The Robinson U.S. Pat. No. 3,101,385, dated Aug. 20, 1963, suggests an AC arc furnace may be provided with a consumable graphite arcing electrode having a continuous passage formed longitudinally through it and through which, among other additives, iron ore may be fed to a molten bath in the furnace. Further, that the electrode can be provided with additional passages through which a monatomic gas can be fed for injection into the arc, to provide the arc with a high electron density, to produce arc stabilization, and to have a force which keeps slag away from the arc zone.

DeCorso U.S. Pat. No. 3,736,358, dated May 29, 1973, discloses an AC arc furnace using a non-consumable tubular electrode having a hollow fluid-cooled wall internally lined with a refractory forming a feeding passage through which iron ore and a reducing agent are alternately fed to an arc formed between the tip of the electrode and a melt in the furnace. The furnace is provided with means for tapping off the melt and slag floating on the melt, as required. For continuous feeding of both the ore and reducing agent, the non-consumable electrode is provided with separate feed passages for the ore and reducing agent.

On Feb. 24, 1976, U.S. Pat. No. 3,940,551 issued on an application filed Mar. 28, 1974 by Bernt Ling and the present inventor, this patent being assigned to the assignee of the present continuation-in-part application and its original applcation Ser. No. 588,179.

This Ling et al patent discloses a DC arc furnace using a cathodic tubular graphite arcing electrode internally containing a ceramic feed pipe through which powdered iron ore is fed to a DC arc formed between the electrode's tip and an anodic carbonaceous iron melt having a layer of coke floating on top of the slag floating on that melt. An annular space is formed between this ceramic feed pipe and the graphite inside of the tubular electrode and through which passage a non-oxidizing gas is fed to surround and confine the ore feeding to the melt via the tip of the electrode. This patent states that the coke in powdered form may be mixed with the powdered ore for feeding through the feed pipe. The ore feed is continuous with slag and carbonaceous iron being tapped from the furnace as required.

At the time this Ling et al patent was obtained, the present applicant and his coinventor Ling, had found that by their invention they obtained a surprisingly high iron production rate. The non-oxidizing gas fed at high velocity through the annular space between the ceramic tube and the graphite electrode was considered necessary to prevent the powdered materials from being blown about in the furnace and lost via exhausting furnace gases. They believed that the ceramic tube protected the graphite electrode's interior from reacting with the iron oxide of the ore feed. However, it did not appear that these factors alone fully accounted for the high iron production rate obtained.

Therefore, they were lead to the belief that the DC arc pulled the iron bath upwardly to form a meniscus which gravitationally flowed away both the slag and coke layers so as to leave a bare metal crown into which the powdered ore fell. Conditions in the arc furnace made visual observation of the arc and its action substantially impossible; this inventor and his coinventor believed the meniscus was formed because nothing within their knowledge of the prior art could otherwise account for the results they obtained.

SUMMARY OF THE INVENTION

In the present invention the powdered iron ore is mixed with the powdered coke, or other carbonaceous material, substantially in excess of that required stoichiometrically for the reduction of the oxides. In other words, the mixture contains a substantial excess of carbonaceous material. This mixture is fed through the cathodic tubular graphite electrode but without using the internal ceramic feeding tube, so this feeding passage has a wall formed by the graphite which is inherently reactive with the oxides of the mixture; the Ling et al patent gas sheath is not used to confine the flow of mixture. The top of the passage through the tubular graphite electrode, is blocked against upward flow of the furnace gases therethrough, so the mixture of oxide and excessive carbon powder or particles can free-fall through the arcing electrode's passage and into the melt without meeting a counterflow of furnace gases.

The present inventor discovered that under the above conditions the feed of iron oxide material particles, or iron oxide containing particles mixed with the excess of the carbonaceous powder material, falls so freely and so rapidly through the unprotected interior of the tubular graphite electrode that there is no appreciable reaction between the oxide and the graphite electrode. The complications of the Ling et al patent are eliminated, making possible the design of a commercial furnace and the operation of a commercially practical method.

The present inventor now believes that when the cathodic graphite electrode forms the DC arc with the anodic iron melt, that no meniscus is formed by the melt as he formerly believed. He had found that DC operation under such conditions inherently produces a steady arc which does not inherently blow the powdered materials away from the arc but does have the necessary force to blow away from the arc foot slag and coke floating on the iron melt.

Because the falling powdered oxide includes the powdered coke or other carbonaceous material in excess of the stoichiometrically required proportions for the reaction between the oxide and carbon to be complete, and because of the rapid fall of the mixture unimpeded by rising furnace gases in the feeding passage, the oxide does not appreciably react with the graphite wall formed by the feeding passage represented by the inside of the graphite electrode.

The present invention is now being incorporated into a furnace designed for commercial operation and which will be assembled and operated at Domnarfvets Jernverk, Borlänge, Sweden.

This furnace is being made and will be assembled by the assignee of the Ling et al patent and of the present application.

BRIEF DESCRIPTION OF THE DRAWINGS

The accompanying drawings schematically show the principles of the present invention and illustrate the furnace design for commercial operation, the various figures being as follows.

DETAILED DESCRIPTION OF THE INVENTION

Figure 1:
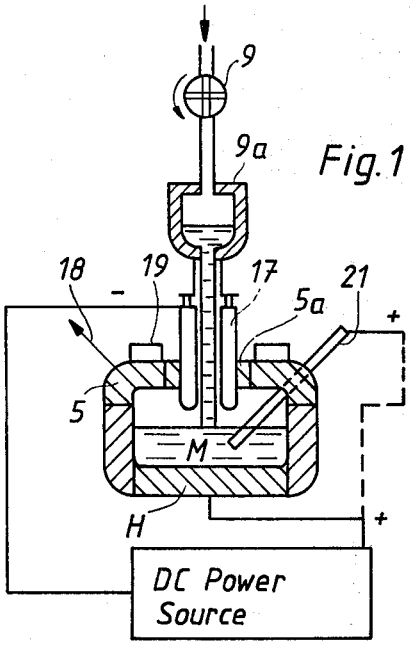
FIG. 1 schematically illustrates in vertical section an example of the furnace of this invention.

FIG. 1 serves to show the general organization of an electric furnace embodying the present invention. The tubular electrode 17, here supplied by the feeder 9, via a batching vessel or chamber 9a, for providing better flow rate uniformity, feeds through the tubular electrode 17 which extends through the bushing 5a in the roof 5. This bushing 5a would normally be a refractory and, therefore, electrically non-conductive, which might be a matter of interest in the event the roof 5, or furnace cover, is itself electrically conductive. A gas exhaust for the cover 5, is indicated by the arrow 18. Water or air-cooling for at least the cover is indicated at 19, formed by either water or air channels.

In addition, FIG. 1 shows that the anodic connection from the DC power source 6 may be made either to the hearth H of the furnace or, if desired, by an anodic electrode 21 inserted through the furnace and into the melt M, thus eliminating the need for the hearth H to be electrically conductive with the attendant expense of such a hearth.

Figure 2:
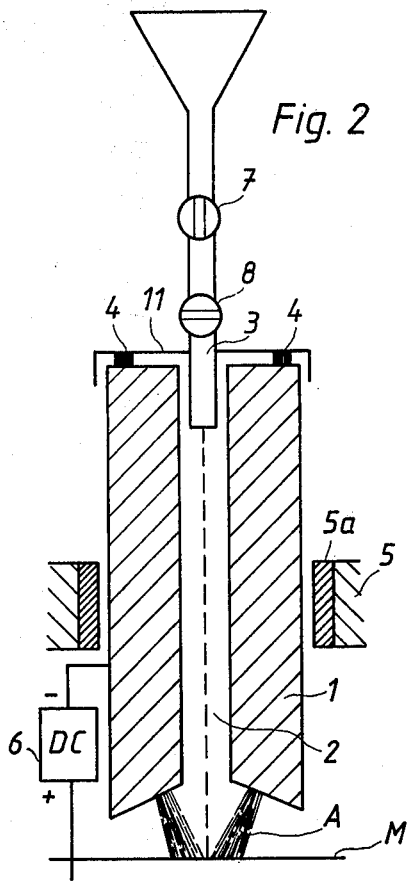
FIG. 2 on an enlarged scale schematically illustrates the salient details of the invention.

Having reference to FIG. 2, the hollow or tubular electrode 1 is being made entirely of graphite or possibly of carbonaceous material encased by an iron or steel sheath. The wall of the electrode is solid and free from passages so that manufacture of the electrode is free from complications. The central longitudinally extending hole formed through the electrode provides the feed line 2, the top of the electrode having a feed pipe 3, which may be metal, extending downwardly a short distance within the electrode, upward escape of gases which might otherwise bypass the feed pipe 3, being blocked by seals 4. Only a portion of the furnace roof 5 is shown, the electrode extending through the roof by way of the hole provided with a bushing 5a.

The DC are powering source is shown at 6, negatively connected with the electrode 1 and positively connected with the melt M below the electrode, this providing for the formation of an arc A between the bottom end of the tubular electrode 1 and the carbonaceous melt M.

The feed pipe 3 is provided with two valves 7 and 8 so that the valves may be alternately opened and shut to feed the mixture of powdered iron oxides or iron oxide containing particles and carbonaceous material, such as powdered coke, into the passage 2 of the electrode. In all cases, upward flow of carbon-oxide gases formed by reaction of the oxide with the carbonaceous material, is blocked against flowing backwardly through the feed pipe 3, this being done by alternate operation of the valves 7 and 8. The passage 2 is blocked against upward flow of gases such as carbon monoxide.

In accordance with the method of this invention, by alternate operation of the valves 3 and 7 a mixture of iron ore or iron oxide containing material and carbonaceous material, both powdered or particulated, is fed through the passage 3 in direct exposure to the inside wall of the tubular electrode 1 which, being reacting with the oxide, is possibly capable of reducing the oxide with consequent loss of the electrode material.

To avoid the above reaction, the iron oxide, such as iron ore or iron oxide containing material possibly partially reduced by previous treatment, in powdered form, is mixed with carbonaceous material, such as powdered coke, and fed through the passage 2 formed by the directly exposed wall of the electrode 1.

This mixture should have its carbon component proportioned relative to its oxide component so that any reduction of the oxide may be effected by the carbon component of the mixture itself, rather than by the inner wall of the electrode 1. The proportioning can be effected to meet this requirement, by any chemist.

In addition to the above, the carbon component may be used in excess of that indicated so as to continually add carbon to the carbonaceous melt M. No other feed of carbonaceous material is required to maintain the carbon content of the melt M which is the iron melt requiring a high enough carbon content to assure reaction with the oxides fed to it.

Depending on the feeding rate through the passage 2 and assuming an excess of carbon over that required for complete reaction with the oxide component, and, therefore, reduction of the oxide to obtain its iron, and the probable temperatures involved and heating rate of the mixture as it falls through the passage 2, it would be possible to determine to what extent reduction of the iron oxide occurs during its passage downwardly to the melt M. In this connection, the heat of the arc A would have to be included as a factor.

However, the important thing is that using the excess of carbon, the inside wall of the electrode 1 is protected against being robbed by reaction with the oxide, while at the same time this inner wall is protected from the gases resulting from the desired reduction of the oxide. In other words, with the upper end of the passage 2 blocked completely against upward gas flow, such gases cannot enter the lower end of the passage 2, counterflow to the descending material. Obviously, the feed pipe 3 is completely protected against oxidation and may, therefore, be made quite simply of steel, this applying in a general way also to the flange or cover 11. The need for the ceramic pipe previously indicated in connection with what was prior art with respect to the present invention, is eliminated safely. In addition, the need for a separate feeding arrangement for the carbonaceous material, which again could be powdered coke, to the melt M, is eliminated. The present invention effects substantial simplification in these respects.

With the present invention, the previous need for a ceramic or non-oxidizable feed passage for the mixture, is eliminated; the need for a separate carbonaceous material feeding arrangement through the roof 5 of the furnace, is eliminated. If a separate feed pipe within the tubular electrode is desired, it may be ferrous in character, such as by using a steel, being less expensive than ceramic material. A metal feed pipe is much more resistant to damage than is a ceramic pipe. Furthermore, in addition to the protection afforded by the carbonaceous material mixed with the feeding iron oxide, a more vigorous and immediate reduction of the iron oxide is inherent to the present invention. Surprisingly, there is reason to believe that the reduction of the iron oxide is largely or entirely effected by the carbonaceous material of the mixture fed through the annular arc to the exposed carbonaceous melt, indicating that very little excess of the carbonaceous material, above that required for combination with the oxygen of the iron oxide in the feed mixture, is required to maintain the melt in a highly carbonaceous condition. It is, of course, possible to maintain the furnace enclosure above the iron melt, filled with a non-oxidizing gas, simply by regulating the exhaust rate of the carbon monoxide gas formed in the reduction reaction. This may be accomplished by a valve in the exhaust line 18.

The foregoing description is substantially a duplicate of portions of the present inventor's original application. As previously indicated, the present inventor now does not believe or at least sincerely doubts that the arc draws a meniscus in the melt. He now believes that the use of a tubular graphite electrode, or in other words, a consumable tubular electrode which might possibly be of the Soderberg type, when operated cathodically with the melt the anode, under DC arc operation, inherently, and surprisingly, has the force to drive away the slag and coke or other carbonaceous material, so as to leave a bare spot on top of the carbonaceous iron melt at the foot of the arc, to which the mixture of oxide and excess carbon particles are fed. He believes it possible that the arc even drives a slight depression in the melt as was suspected in the crown of the meniscus which the present inventor and his coinventor thought to occur in the case of the invention of the Ling et al patent. In the case of this DC arc the gas excitation of the AC arc described by the Robinson patent is not required.

Because the feed passage is blocked against an upflow of the furnace gases resulting from the reaction between the oxide and carbon, and considering the fact that the DC operation described inherently produces a smooth and steady arc, the powdered materials fed to the arc and melt are not blown about within the furnace so as to be lost within the usual furnace gas exhaust system. The separate gas sheath thought necessary in the case of the Ling et al patent invention is not required. Because the upflow of gas through the feeding passage is blocked, the mixture of oxide and excess carbon particles fall through the tubular or hollow graphite arcing electrode rapidly and this in conjunction with the excess of carbon in the mixture prevent any substantial or material reaction between the oxides and the graphite wall of the feeding passage formed by the inside of the tubular arcing graphite electrode. Because the fall of the mixture is rapid, being unimpeded by the upflow of furnace gases, there is no chance for a premature reaction between the oxide and carbon occurring within the passage such as might result in blockage of that passage.

The carbon of a carbonaceous iron melt in the furnace is gradually diluted by the iron formed from the iron ore whether or not it is concentrated by a prior partial reduction treatment. The extra carbon included with the mixture, substantially above the stoichiometrical requirement for the reaction between the oxide and the carbon of the mixture, in addition to protecting the graphite wall of the feeding passage, has the added advantage of continuously adding carbon to the carbonaceous melt to replace that lost by dilution.

As previously indicated, the discoveries of the present invention have provided the confidence required for the assignee of the Ling et al patent and of the present invention, to design and build a commercial sized furnace for practicing the present invention. This furnace, substantially to scale, is illustrated by FIGS. 3 to 5 of the drawings of this application.

Figure 4:
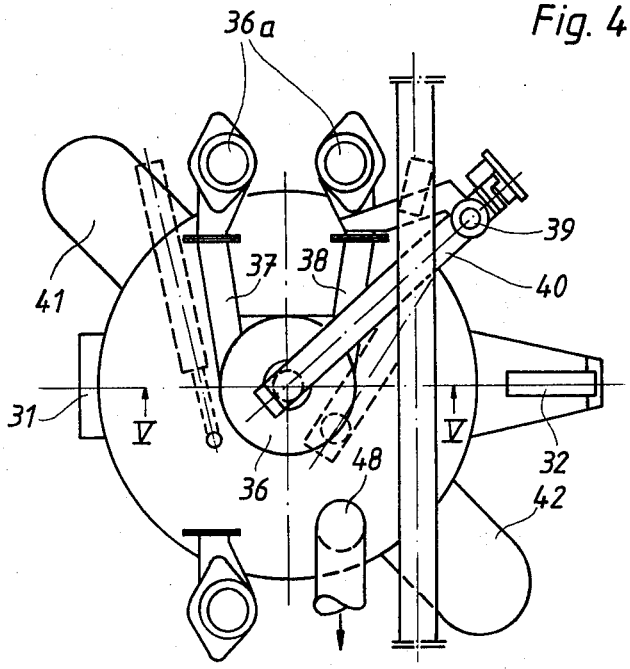
FIG. 4 is a top view looking down on the line IV—IV in FIG. 3.
Figure 3:
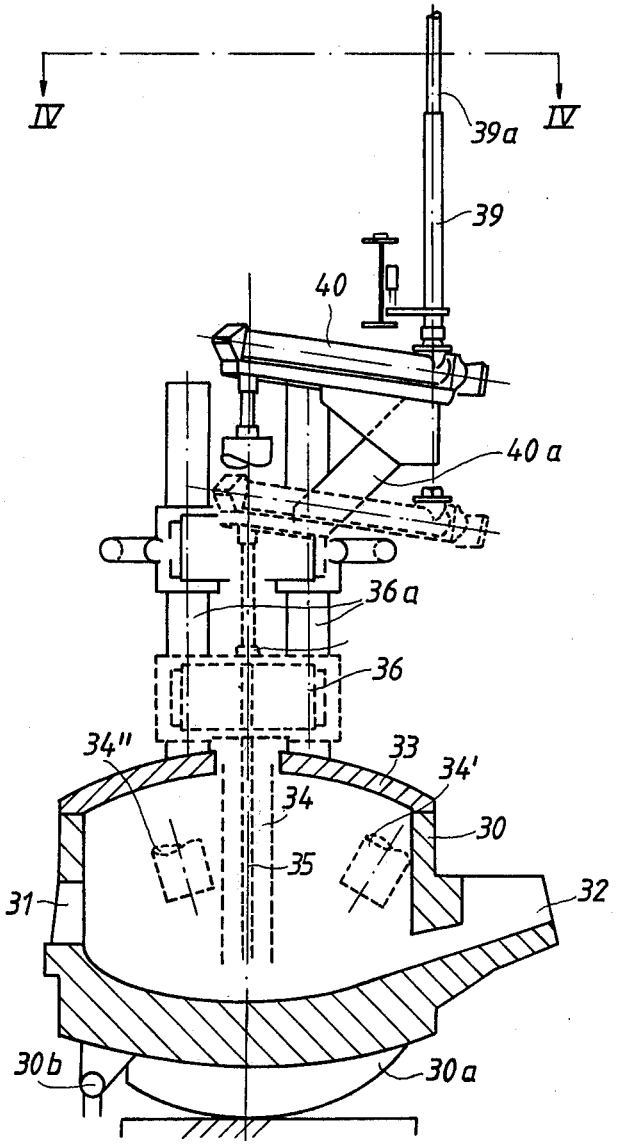
FIG. 3 partly in vertical section and partly in elevation illustrates the commercial design of the new furnace.
Figure 5:
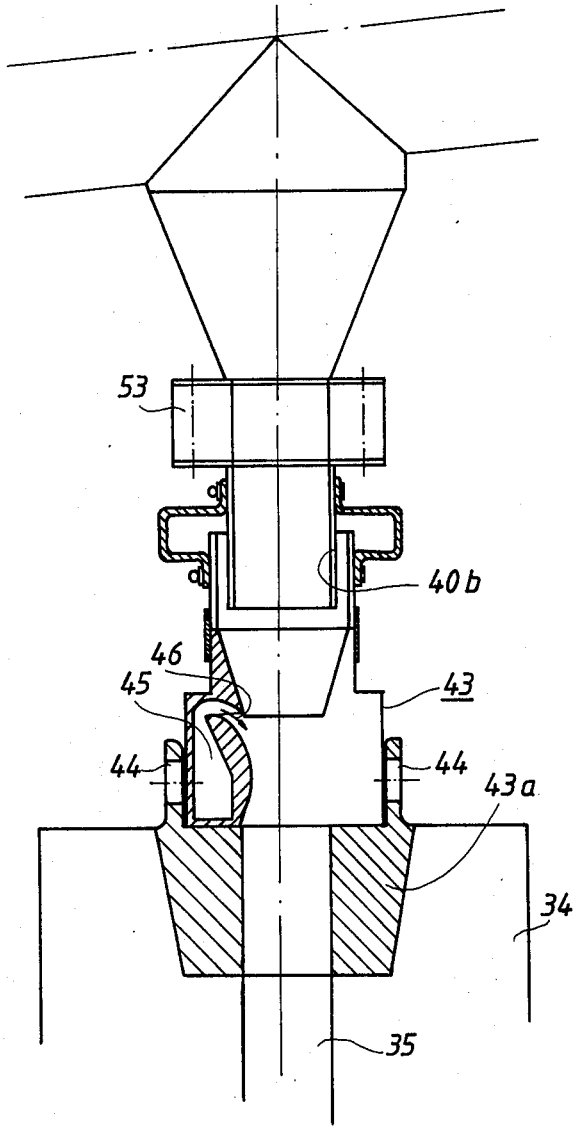
FIG. 5 is a vertical section taken on the line V—V in FIG. 4.

Referring first to FIGS. 3 and 4, this commercial design of the invention comprises a tiltable furnace 30 supported by rockers **30*a* and tilted by a mechanism generally illustrated at 30*b*, this furnace having a slag tapping port 31 and a melt tapping spout 32. For deslagging and possibly for the removal of possibly excessive coke particles, the furnace is tilted to the left, and for tapping of the carbonaceous iron produced, the furnace is tilted to the right for pouring via the spout 32. During the continuous operation of the furnace these tappings are effected intermittently as required. This is a full-sized commercial furnace, it having a maximum capacity of 25 tons of melt, although the melt may be tapped when lesser amounts have accumulated. This furnace is a generally conventional construction having a roof 33 provided with a furnace gas exhaust port 48** via which gases formed in the furnace are removed in the usual fashion.

The hollow or tubular graphite electrode 34, which may be conventional excepting for being tubular, is inserted through a sealed electrode opening through the roof 33. The feeding passage 35 which extends longitudinally entirely through this graphite electrode 34 is formed directly by the graphite inside of this tubular electrode. The ceramic feeding tube of the Ling et al patent is unnecessary and is not used, thus avoiding the complications of that construction.

This tubular graphite arcing electrode 34 is supported substantially conventionally by an electrode holder 36 which is vertically movable and is supported by two columns **36*a* which tilt with the furnace. In FIG. 3 the electrode holder 36** is shown in its uppermost position by solid lines and in its lowermost position by broken lines. This vertical movement is required for feeding the graphite and, therefore, consumable electrode downwardly as the electrode is consumed during the operation of the furnace.

The feed of the mixture of iron oxide and carbon is via a vertical pipe connected with the schematically indicated source and comprising a mutually telescoping sections 39 and 39*a*, this pipe connecting with one end of a screw conveyor 40 which feeds forwardly into the upper end of a connection 43 connecting with the top end of the hollow or tubular graphite electrode, this connection being illustrated more in detail by FIG. 5 described hereinafter. These parts comprising the connection 43, the feed screw or screw conveyor 40 and the lower or fixed or standing part 39 of the feed pipe from the source, are mounted via a bracket 40*a* to the electrode holder 36 so that these parts move vertically with the electrode support 36 as the latter is fed downwardly while the tubular or hollow graphite electrode is being consumed. In addition, these parts can tilt with tilting of the furnace.

As shown by FIG. 4, the electrode support 36 is carried by two cantilever support arms 27 and 28 mounted by the columns 36*a*.

Although not illustrated to avoid confusion, the cathodic arcing DC power connection is, of course, to the electrode holder 36, the anodic connection being in the usual way via hearth electrodes which are positioned in side hearth pockets 41 and 42 and into which the melt extends to establish the electrical contact. The pockets 41 and 42 are shown in diametrically opposite positions so that the arc form can be expected to be vertical.

The necessary blockage for the upper end of the feeding passage 35 formed by the bare interior of the graphite electrode 34 is shown in detail by FIG. 5. This comprises a unit having electrical insulation 53 isolating the electrically charged electrode 34 from the rest of the furnace feeding details, and connecting with the feed screw 40 via this electrical insulation by way of a depending pipe section 40*b* below which the connection 43 itself comprises a hollow body having a tapered bottom nozzle 43*a* which fits in a correspondingly shaped socket in the top of the graphite electrode 34 while providing gas inlets 44 which connect with an annular manifold 45 and via annularly and downwardly pointing orifice 46 provides for a downward flow of pressurized gas, such as nitrogen, providing an adequate fluid reaction to rising furnace gases to block upward travel of the latter through the feeding passage 35 of the electrode 34. It should be noted that this downward injection of gases is not for the purpose of necessarily providing any kind of sheath around the material falling from the lower end of the tubular electrode. Instead the purpose is to block any upward flow of furnace gases which might impede the gravitational flow of the falling mixture of oxide and excess carbon powders or granules.

An alternate construction can comprise a reduction in the diameter of the feeding tube section 40*b* shown by FIG. 5 and its extension down through the feeding passage 35 to a location spaced upwardly from the lower end of the graphite electrode. Then, if this extension of the feeding tube 40*b* is of reduced diameter and is made of a material which withstands the heat involved, this feeding tube, the screw conveyor 40, and the feeding tube 39, may be fixedly positioned so that they remain stationary during the feeding of the consumable arcing electrode, the bottom end of such a heat resistant tube being spaced well upwardly away from the arc heat while still permitting its lower end to remain inserted in the feeding passage 35 of the electrode 34 when the latter is fed to its lowermost possible position.

For commercial production, the mixture must be fed in such volume as to necessarily contact the inside of the electrode. It cannot be fed neatly as a stream free from such contact.

When this furnace of FIGS. 3 through 5 is placed in operation, the roof 33 will be removed for initially charging the hearth of the furnace with starting material for the carbonaceous iron melt and possibly a charge of coke floating as a layer on this melt, the furnace being upright at that time. The foot will be put on place. The arcing electrode 35 will be adjusted with a DC arc maintained between its tip and the melt with the electrode cathodically powered and the melt via the unillustrated melt contacts in the pockets 41 and 43, anodically powered. This commercial version is designed for DC power of from 425 down to 100 volts with the furnace in an unloaded condition, the maximum current intensity contemplated being 52 KW and the maximum arc effect anticipated being 8,000 KW; the maximum melt capacity is 25 tons.

With the arc struck, a feed of pretreated or partially reduced iron ore particles mixed with coke particles in a quantity in excess of that required for reduction of the iron ore to iron will be fed via 39*a* and 39, and with the screw conveyor 40 operating this feed will be conveyed to the upper end of the hollow or tubular graphite electrode 34, the connection being via the arrangement shown by FIG. 5, pressurized inert gas such as nitrogen being fed through the inlets 44 to block upward flow of furnace gases through the passage 35 directly formed by the inside of the electrode 34.

Under such conditions the mixture of iron ore and coke, in other words, iron oxide and carbon particles, flows freely down through the passage 35, and because of the excess carbon or coke and the rapidity of the free fall of the mixture, there is no substantial reaction between the ore or oxide and the graphite interior of the passage 35.

Because of the DC arc struck by the cathodic graphite electrode, any slag and coke layers floating on the melt in the furnace are driven forcibly aside, presumably by the force of the DC arc and without necessarily any formation of a meniscus on the part of the melt, the presence or absence of which is difficult to detect but insofar as can be determined, no meniscus being formed. The force of the DC arc, unaided by any complication involving feeding it with a monotomic gas or the like, adequately forces away everything covering a bare melt spot below the arc and to which the oxide and carbon particles are fed. Even a thick slag layer can be blown or forced away from that spot.

The excess carbon, which should be in excess of the stoichiometric requirements for the reaction between iron oxide or oxides present in the mixture and the carbon of carbonaceous material present in the mixture, not only protects the bare carbon interior of the graphite electrode from reacting with the oxide component of the feed, but also serves to continuously add carbon to the melt to replace that lost by dilution. For safety of operation, the carbon content of the feed mixture should preferably be substantially in excess of that required for a complete reaction with the oxide component of the mixture. If this results in the iron becoming supersaturated with carbon, the excess carbon only floats as coke on the surface of the melt.

Because the operation is continuous, the level of melt slag and possibly coke in the furnace will continuously rise. As these levels rise close to the desired maximum levels, the furnace is tilted to the left for deslagging and coke removal, when necessary, and to the right for removal of the carbonaceous iron recovered from the iron oxide or ore component of the mixture.

Preferably the carbon content of the mixture fed to the arc will be proportioned to provide an excess safely sufficient to in conjunction with the rapid fall of the material protect the inside of the tubular graphite electrode 35 from excessive loss by reaction with the oxide component of the mixture, and to just safely keep the iron melt highly carbonaceous, or in other words, saturated with carbon as required for the melt reduction process.

As the graphite electrode is consumed, it is, of course, lowered as required, by the electrode holder 36 lowering together with the screw conveyor 40 of the fixed portion 39 of the telescopic feed pipe.

In all of the foregoing the arc is an open or direct arc as contrasted to submerged arc practice, that more than one iron oxide may be involved and that the carbon may be in the form of coke, coal or the like, and for a high iron production rate, supplied to the tubular graphite electrode as a mixture having a volume such as to necessarily contact the graphite wall of the feed passage formed by the electrode's inside, as the mixture free-falls through the feed passage. Dry materials in the form of powder or particles of small particle size are used. The furnace gases are largely carbon monoxide formed by the reduction of the oxide by the carbon, and carbon is continuously added to the melt by the excess carbon of the mixture fed to the melt.

What is claimed is:

1. The method for reducing the iron oxide content of iron oxide containing material in powdered form by feeding a mixture of the material and powdered carbon-containing material into the top of a refractory ceramic tube positioned within the carbonaceous inside of a tubular carbonaceous electrode, the tube forming an annular gas passage between the tube and said inside and gas being injected into this passage, the tip of the electrode forming an arc with a carbonaceous iron melt with the arc powered by DC so that the melt is anodic and the electrode is cathodic and the gas ejecting from the bottom of said passage forming a gas sheath around the mixture feeding from the bottom of said tube; wherein the improvement comprises eliminating said tube and gas sheath, adjusting said mixture so that its carbon content is in excess of that stoichiometrically required to react with its said oxide, and feeding the adjusted mixture directly through said carbonaceous inside of said tubular electrode while blocking said inside against upward flow of gas formed by reduction of the mixture's said oxide, so that the mixture free-falls through the electrode's carbonaceous inside and into the arc and melt without the mixture's oxide content substantially reacting with the carbon content of said carbonaceous inside.

* * * * *